US006273744B1

(12) United States Patent
Murdock et al.

(10) Patent No.: US 6,273,744 B1
(45) Date of Patent: Aug. 14, 2001

(54) SELF-ALIGNING CONNECTOR ASSEMBLY

(75) Inventors: Jay Allan Murdock, Redford; Albert Wojewnik, Royal Oak, both of MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 09/561,488

(22) Filed: Apr. 28, 2000

(51) Int. Cl.[7] ..... H01R 13/64
(52) U.S. Cl. ..... 439/374; 439/252
(58) Field of Search ..... 439/376, 374, 439/660, 326, 341, 372, 338, 246, 248, 252

(56) References Cited

U.S. PATENT DOCUMENTS

| | | | | |
|---|---|---|---|---|
| 2,749,526 | * | 6/1956 | Petersen | 439/320 |
| 3,497,866 | | 2/1970 | Patton, Jr. . | |
| 3,701,071 | * | 10/1972 | Landman | 200/5 R |
| 3,816,836 | | 6/1974 | Smith . | |
| 3,816,837 | | 6/1974 | Smith . | |
| 3,831,133 | | 8/1974 | Grundfest . | |
| 3,980,380 | | 9/1976 | Cieniawa et al. . | |
| 4,565,001 | | 1/1986 | Patton . | |
| 4,626,061 | | 12/1986 | Patton . | |
| 4,789,343 | | 12/1988 | Dougherty et al. . | |
| 5,451,169 | | 9/1995 | Corbett, III et al. . | |
| 5,667,393 | * | 9/1997 | Grabbe et al. | 439/83 |
| 5,752,853 | | 5/1998 | Curtindale . | |
| 5,830,018 | | 11/1998 | Simmel . | |
| 6,010,369 | * | 1/2000 | Itabashi et al. | 439/660 |

* cited by examiner

*Primary Examiner*—Gary Paumen
*Assistant Examiner*—Ross Gushi
(74) *Attorney, Agent, or Firm*—Brooks & Kushman P.C.

(57) ABSTRACT

The present invention involves a self-aligning connector assembly adapted for connecting first and second electrical conductors. The invention may be incorporated within a door panel assembly of a vehicle. The self-aligning connector assembly provides for self-aligning assembly techniques of vehicle panels to sheet metal structures. The connector assembly comprises a male connector, a female connector receiving the male connector, and a conductive member disposed on the female connector. The male connector has a base portion and a head portion. Head portion tapers from the base portion to form an arcuate top. The base portion has a conductive area disposed thereon and adapted to connect to the first electrical conductor, such as electrical wires. The female connector has a body portion defining an opening and has inner and outer surfaces. The inner surface of the female connector receives the male connector and is formed to complement the shape of the male connector and is cooperable with the arcuate top of the male connector to facilitate the self-alignment of the male and female connectors. The outer surface of the female connector has a slot formed thereon. The conductive member is accessible by way of the slot of the female connector wherein the conductive member has a contact area and a wire area. The wire area is adapted to connect the second electrical conductor, such as electrical wires. The contact area engages the conductive area of the male connector when the male and female connectors are self-aligned and the male connector is received in the female connector.

21 Claims, 3 Drawing Sheets

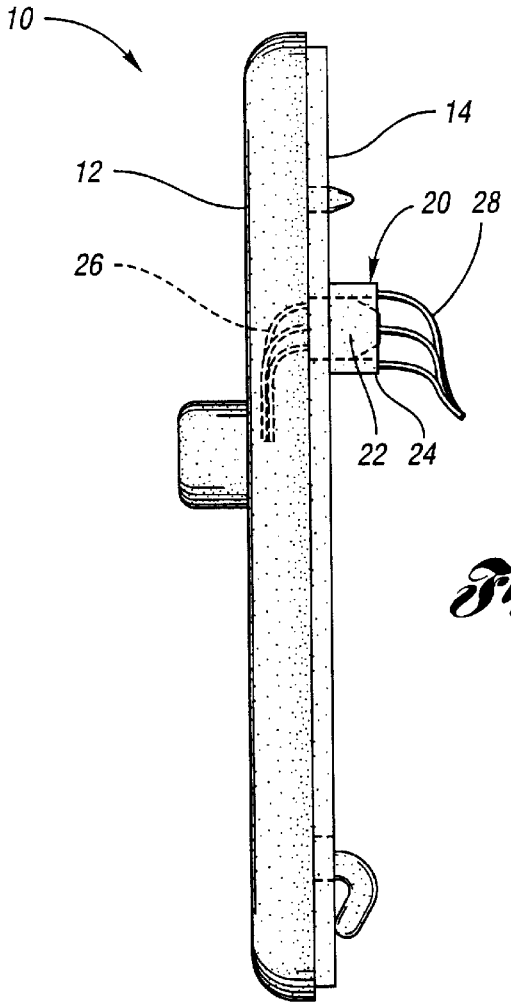
Fig. 1
Fig. 2
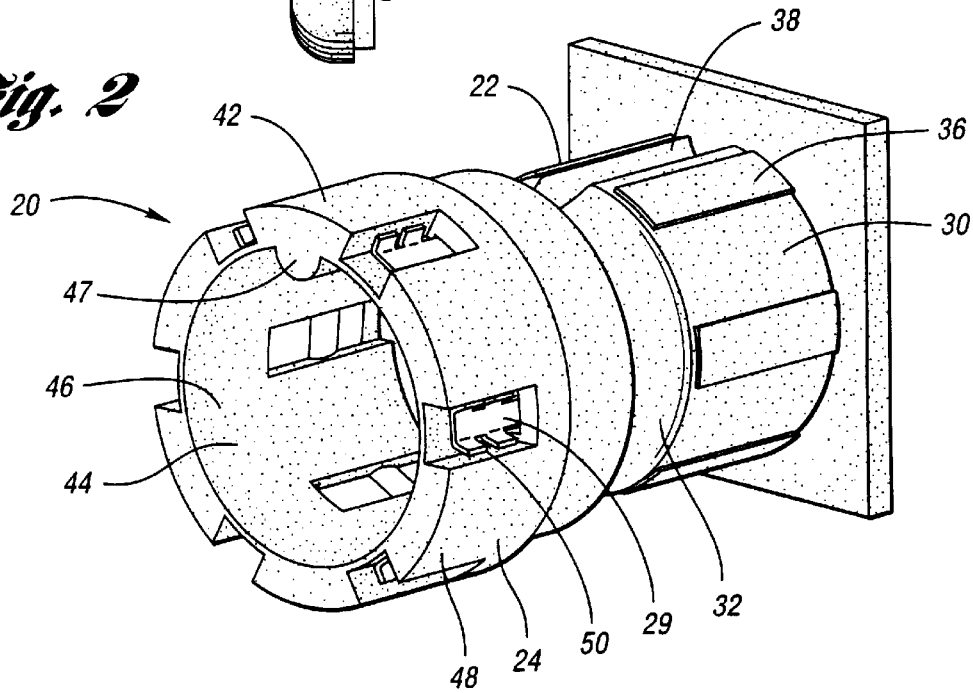

SELF-ALIGNING CONNECTOR ASSEMBLY

TECHNICAL FIELD

The present invention relates to a self-aligning connector assembly for connecting electrical conductors together through a vehicle compartment structure.

BACKGROUND ART

In a vehicle, there is a need to improve the attachment of electrical connectors through a sheet metal structure of the vehicle. Typically, a vehicle door panel is attached to the sheet metal structure of the vehicle by attachment hooks and/or fasteners mounted to the door panel. In many situations, the vehicle includes electrical switches featured on the show surface of the door panel, requiring a wire harness for the switch to be manually fed or threaded through an aperture of the sheet metal structure prior to attaching the door panel to the sheet metal structure. The wire harness connects to a receiving harness mounted to the switch of the door panel. Generally, the hooks mounted on the door panel are disposed through receiving slots of the sheet metal structure. Then, the door panel is pivoted toward the sheet metal structure such that the fasteners are inserted into receiving sockets of the sheet metal.

Although such assemblies are adequate for attaching door panels to sheet metal structures and connecting wire harnesses together, the assembly can be improved in order to lessen the manufacturing time of the door panels. Manually feeding the wire harness through the sheet metal may involve a significant amount of time and may involve more than one assembly technician. In many cases, as the attachment of the door panel to the sheet metal structure is a blind attachment, the connection of the wire harness to the receiving harness is typically accomplished with less ease.

Thus, what is needed is an improved connector assembly which connects electrical wires to electrical switches of vehicle panels, such as door panels.

What is also needed is an improved connector assembly which is self-aligning in order to accommodate blind attachments of door panels to sheet metal structures.

DISCLOSURE OF INVENTION

It is an object of the present invention to provide for an improved self-aligning connector assembly adapted for connecting first and second electrical conductors. The assembly comprises a male connector, a female connector receiving the male connector, and a conductive member disposed on the female connector. The male connector has a base portion and a head portion. The head portion tapers from the base portion to form an arcuate top. The base portion has a conductive area disposed thereon and adapted to connect to the first electrical conductor. The female connector has a body portion defining an opening and has inner and outer surfaces. The inner surface of the female connector receives the male connector and is formed to complement the shape of the male connector and is cooperable with the arcuate top of the male connector to facilitate the self-alignment of the male and female connectors. The outer surface of the female connector has a slot formed thereon. The conductive member is accessible by way of the slot of the female connector wherein the conductive member has a contact area and a wire area. The wire area is adapted to connect the second electrical conductor. The contact area engages the conductive area of the male connector when the male and female connectors are self-aligned and the male connector is received in the female connector.

It is another object of the present invention to provide for an improved self-aligning door panel assembly adapted for connecting a First substrate to a second substrate to attach first and second electrical conductors therethrough. The assembly comprises a male connector mounted to the first substrate, a female connector mounted to the second substrate, and a conductive member disposed on the female connector. The male connector has a base portion and a head portion. The head portion tapers from the base portion to form an arcuate top. The base portion has a conductive area disposed thereon and adapted to connect the first electrical conductor. The female connector has a body portion defining an opening and has inner and outer surfaces. The inner surface of the female connector receives the male connector and is formed for compliment the shape of the male connector. The inner surface is cooperable with the arcuate top of the male connector to facilitate the self-alignment of the male and female connectors. The outer surface of the female connector has a slot formed thereon. The conductive member is accessible by way of the slot of the female connector wherein the conductive member has a contact area and a wire area. The wire area is adapted to connect the second electrical conductor and the contact area engages the conductive area of the male connector when the male and female connector are self-aligned and the male connector is received in the female connector. The first and second substrates are in aligned relationship with each other such that when the first substrate connects to the second substrate the female connector receives the male connector, thereby attaching the first electrical conductor to the second electrical conductor.

It is yet another object of the present invention to provide for an improved self-aligning door panel assembly of a vehicle for connecting first and second electrical conductors. The assembly comprises first and second substrates of the vehicle wherein the first substrate is attached to the second substrate. The assembly further comprises a male connector mounted to the first substrate, a female connector mounted to the second substrate, and a conductive member disposed on the female connector. The male connector has a base portion and a head portion. The head portion tapers from the base portion to form an arcuate top. The base portion has a conductive area disposed thereon and adapted to connect to the first electrical conductor. The female connector has a body portion defining an opening and has inner and outer surfaces. The inner surface of the female connector receives the male connector and is formed to compliment the shape of the male connector and is cooperable with the arcuate top of the male connector to facilitate the self-alignment of the male and female connectors. The outer surface of the female connector has a slot formed thereon. The conductive member is accessible by way of the slot of the female connector wherein the conductive member has a contact area and a wire area. The wire area is adapted to connect the second electrical conductor. The contact area engages the conductive area of the male connector when the male and female connectors are self-aligned and the male connector is received in the female connector. The first and second substrates are in aligned relationship with each other such that when the first substrate connects to the second substrate the female connector receives female connector, thereby attaching the first electrical conductor to the second electrical conductor.

BRIEF DESCRIPTION OF DRAWINGS

FIG. 1 is a side view of a door panel assembly incorporating a connector assembly in accordance with the present invention;

FIG. 2 is a perspective view of the connector assembly in accordance with the present invention;

BEST MODE FOR CARRYING OUT THE INVENTION

Figure 3:
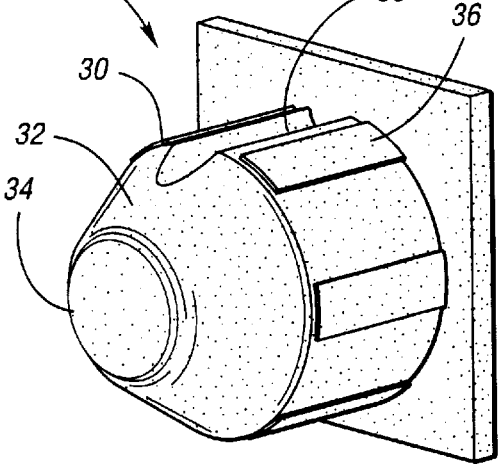
FIG. 3 is a perspective view of a male connector of the connector assembly and FIG. 2.

FIG. 1 illustrates door panel assembly 10 having door panel or first substrate 12 connected to sheet metal structure or second substrate 14. As shown, door panel assembly 10 includes connector assembly 20 having male connector 22 mounted to door panel 12 and female connector 24 mounted to sheet metal structure or second substrate 14. As shown, first electrical conductor or wires 26 are electrically connected to male connector 22. Moreover, second electrical conductor or wires 28 are electrically connected to female connector 24. Upon engagement of male connector 22 to female connector 24, wires 26 are in electrical relationship with wires 28.

FIG. 2 illustrates connector assembly 20 having male connector 22, female connector 24 receiving male connector 22, and conductive member 29 disposed on female connector 24. As shown in FIGS. 2 and 3, male connector 22 includes base portion 30 and head portion 32 tapering from base portion 30 to form arcuate top 34 which is rounded. Base portion 30 has a plurality of conductive areas 36 disposed radially thereon and adapted to connect to wires 26. The conductive areas 36 are spaced circumferentially apart on the base portion 30. As, shown, conductive areas 36 extend longitudinally along base portion 30 toward head portion 32. Male connector 22 further includes first formation or keyway 38. As shown, keyway is formed longitudinally channeling along base portion 30 and head portion 32, and tapering toward head portion 32.

The plurality of conductive areas 36 may be disposed on base portion 30 by any suitable manner. For example, conductive areas 36 may be disposed thereon by room temperature spraying applications wherein metallic powder is absorbed in paint which is sprayed onto selective areas radially on base portion 30. Also, a technique of thermo-spraying may be implemented onto base portion 30. Also, metal terminals may be radially stamped onto base portion 30. Other ways of disposing the plurality of conductive areas 36 on base portion 30 do not fall beyond the scope and spirit of the present invention.

Figure 4:
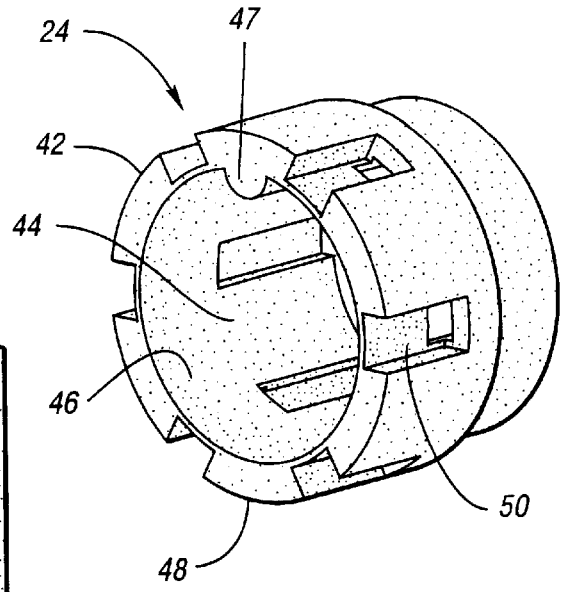
FIG. 4 is a perspective view of a female connector of the connector assembly in FIG. 2.

FIGS. 2 and 4 illustrate female connector 24 having cylindrical body portion 42 which has opening 44 formed therethrough defining inner surface 46 and outer surface 48. As shown, inner surface 44 receives male connector 22 and is formed to complement the shape of male connector 22. Inner surface 46 cooperates to receive arcuate top 34 of male connector 22 in order to facilitate self-alignment of connectors 22, 24. More specifically, in a situation where male connector 22 is inserted into female connector 24 at an angle or incline, the tapering of head portion 32 and arcuate top 34 cooperate with inner surface 46 act to guide male connector 22 for proper insertion and engagement with female connector 24. Regardless of the angle at which male connector 22 is inserted relative to female connector 24, the shape of male connector 22 facilitates the self-alignment of male connector 22 and female connector 24.

Moreover, inner surface 46 includes second formation or key 47 formed thereon. Key 47 is formed onto inner surface 46 to complement the shape of keyway 38 of male connector 22. As male connector 22 inserts into female connector 24, alignment is assured when keyway 38 receives key 47 therealong. It is to be noted that one of keyway 38 and key 47 may be located on either of male connector 22 or female connector 24 so long as the other of keyway 38 and key 47 is located on the other of connectors 22, 24.

Figure 5:
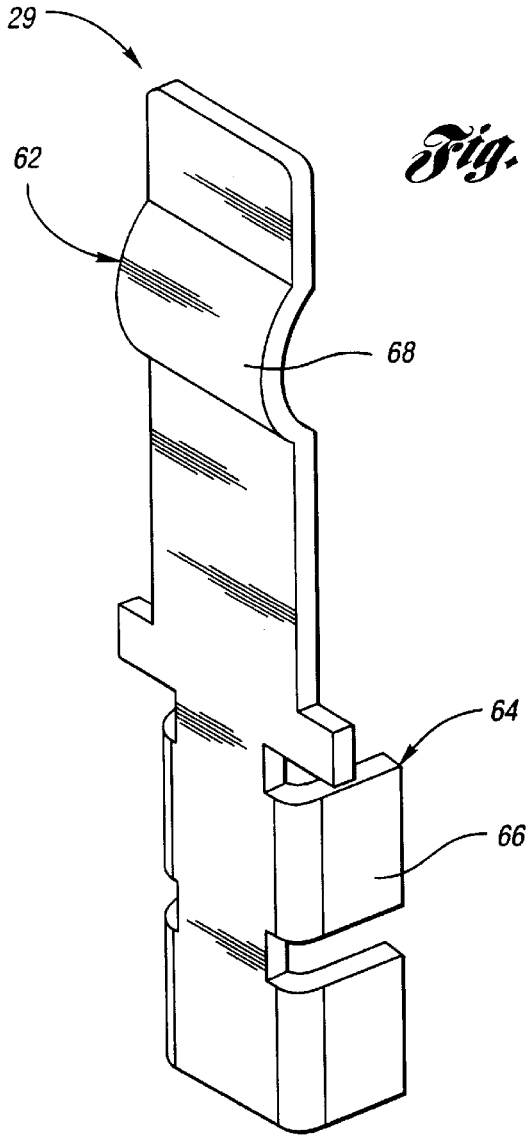
FIG. 5 is a conductive member of the connector assembly in FIG. 2.

Outer surface 48 includes slot 50 radially formed thereon to accommodate conductive member 29 to be disposed therein. The slot 50 is in alignment with the conductive area 36 of the base portion 30 when the male and female connectors 22, 24 are self-aligned and the male connector 22 is received in the female connector 24. As shown, a plurality of slots 50 are radially formed through and spaced circumferentially apart on the outer surface 48 of the female connector 24. Each slot 50 is in radial alignment with one of the conductive areas 36 of the base portion 30 when the male and female connectors 22,24 are self-aligned and the male connector 22 is received in the female connector 24. In FIG. 5, conductive member 29 is an elongated member having contact area 62 on one end and wire area 64 on another end. Wire area 64 includes crimp portion 66 wherein spaced apart legs extend therefrom to allow electrical conductors, such as wires, to be crimped onto crimp portion 66. Second electrical conductor or wires 28 are crimped onto crimp portion 66. Contact area 62 includes raised portion 68 wherein raised portion is formed as a hump therealong. As shown in FIG. 2, each conductive member 29 is radially disposed on outer surface 48 of female connector 24 such that crimp portion 66 face radially outward and raised portion 68 faces radially inward. Thus, upon insertion of male connector 22 into female connector 24, each conductive area 36 of male connector 22 engages raised portion 68 of one conductive member 29, thereby electrically connecting wires 26 to wires 28. Conductive member 29 is made of conductive material, such as copper, such that current may flow therethrough from first electrical conductor 26 to second electrical conductor 28.

Figure 6:
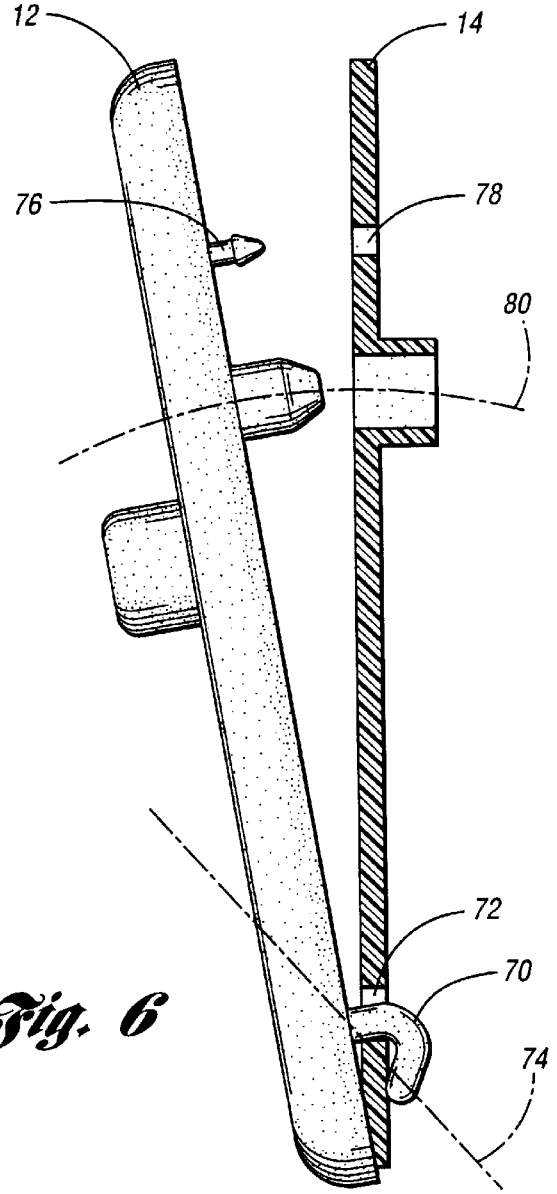
FIG. 6 is a side view of the door panel assembly depicting an arcuate path along which the door panel may move to connect to a sheet metal structure.

FIG. 6 illustrates one embodiment of door panel assembly 10 having insert or hook 70 and fastener 76 mounted to door panel 12, and first socket 72 and second socket 78 formed on sheet metal structure 14. As shown, hook 70 is inserted into first socket 72 creating axis 74 about which door panel 12 partially moves. Door panel 12 pivotally moves about axis 74 along arcuate path 80 in order to insert male connector 22 into female connector 24. Upon engagement of connectors 22 and 24, fastener 76 inserts into second socket 78 formed to receive fastener 76, securing door panel 12 to sheet metal structure 14.

It is to be noted that either of connectors 22, 24 is mounted to door panel 12 as the other of the connectors 22, 24 is mounted to sheet metal structure 14. In this embodiment, male connector 22 is mounted to door panel 12 and female connector 24 is mounted to sheet metal structure 14. Any suitable means may be used to mount connectors 22, 24 to door panel 12 and sheet metal structure 14, respectively. For example, connectors 22, 24 may be integrally molded to the respective substrate. Another example is that connectors 22, 24 may be mounted to the respective substrates by an adhesive, sonic welding or spin welding the connectors. In yet another example, connectors 22, 24 may be connected to the respective substrates by use of integrally molded snap fits, each of which may be molded on the back side of each connector to allow the connector to be snapped into the substrate. Other means for mounting connectors 22, 24 to the substrates do not fall beyond the scope and spirit of this invention.

Figure 7:
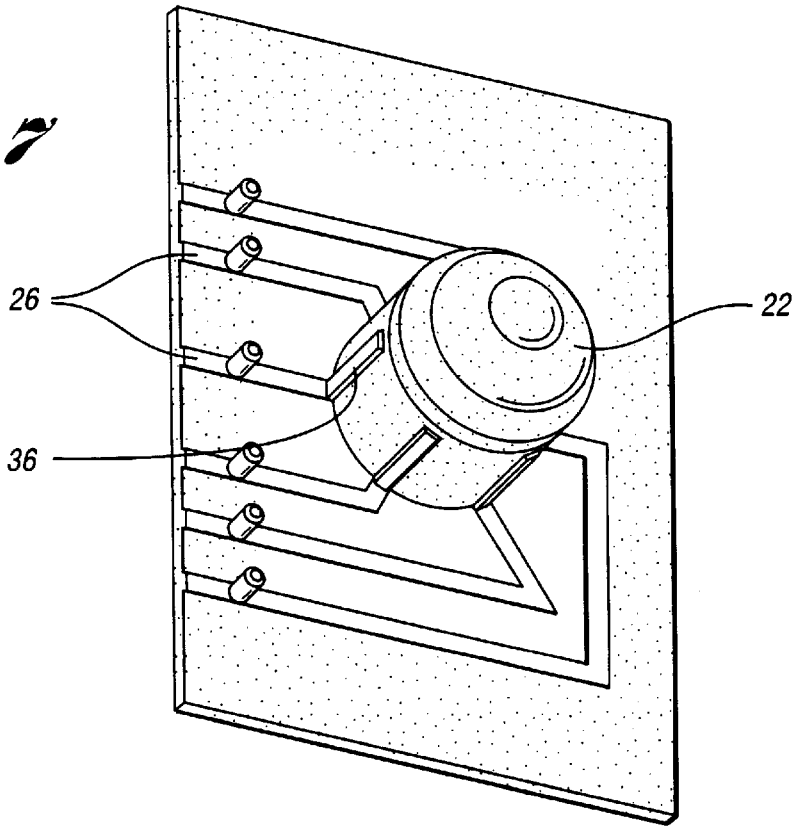
FIG. 7 is a perspective view of the male connector connected to a first electrical conductor.

First electrical conductor or wires 26 may attach to male connector 22 by any suitable means. For example, wires 26 may be pressed onto conductive pins in electrical relationship with conductive area 36, as shown in FIG. 7. As shown, a metal pushnut connector is crimped onto an end of a wire. Other suitable ways of connecting first electrical conductor 26 to male connector 22 do not fall beyond the scope and spirit of this invention.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A self-aligning connector assembly adapted for connecting first and second electrical conductors, the assembly comprising:

a male connector having a base portion and a head portion, the head portion tapering from the base portion to form an arcuate top, the base portion having a plurality of conductive areas spaced circumferentially apart on the base portion and adapted to connect to the first electrical conductor;

a female connector having a body portion defining an opening and having inner and outer surfaces, the inner surface of the female connector receiving the male connector, the inner surface formed to complement the shape of the male connector and cooperable with the arcuate top of the male connector to facilitate the self-alignment of the male and female connectors, the outer surface having a plurality of slots spaced circumferentially apart on the outer surface, the plurality of slots being in radial alignment with the plurality of conductive areas of the base portion when the male and female connectors are self-aligned and the male connector is received in the female connector; and a conductive member accessible by way of one of the slots of the female connector, the conductive member having a contact area and a wire area, the wire area adapted to connect the second electrical conductor, the contact area engaging one of the conductive areas of the male connector when the male and female connectors are self-aligned and the male connector is received in the female connector.

2. The assembly of claim 1 wherein the conductive member is a plurality of conductive members, each conductive member disposed in one of the slots.

3. The assembly of claim 1 wherein the contact area of the conductive member includes a raised portion to which one of the conductive areas of the base portion engages when the male and female connectors are self-aligned and the male connector is received in the female connector.

4. The assembly of claim 1 wherein the male connector has a first formation formed thereon and the female connector has a second formation formed on the female connector, the second formation formed to complement the shape of the first connector, the first and second formations cooperating together to facilitate the self-alignment.

5. The assembly of claim 1 wherein the wire area of the conductive member includes a crimp portion configured to have the second electrical conductor crimped thereto.

6. The assembly of claim 1 wherein one of the conductive areas of the male connector includes a crimp portion configured to have the first electrical conductor crimped thereto.

7. The assembly of claim 1 wherein the first and second electrical conductors are electrical wires.

8. A self-aligning door panel assembly adapted for connecting a first substrate to a second substrate to attach first and second electrical conductors therethrough, the assembly comprising:

a male connector mounted to the first substrate, the male connector having a base portion and a head portion, the head portion tapering from the base portion to form an arcuate top, the base portion having a plurality of conductive areas spaced circumferentially apart on the base portion and adapted to connect to the first electrical conductor;

a female connector mounted to the second substrate, the female connector having a body portion defining an opening and having inner and outer surfaces, the inner surface of the female connector receiving the male connector, the inner surface formed to complement the shape of the male connector and cooperable with the arcuate top of the male connector to facilitate the self-alignment of the male and female connectors, the outer surface having a plurality of slots spaced circumferentially apart on the outer surface, the plurality of slots being in radial alignment with the plurality of conductive areas of the base portion when the male and female connectors are self-aligned and the male connector is received in the female connector; and a conductive member accessible by way of one of the slots of the female connector, the conductive member having a contact area and a wire area, the wire area adapted to connect the second electrical conductor, the contact area engaging one of the conductive areas of the male connector when the male and female connectors are self-aligned and the male connector is received in the female connector, wherein the first and second substrates are in aligned relationship with each other such that when the first substrate connects to the second substrate the female connector receives the male connector, thereby attaching the first electrical conductor to the second electrical conductor.

9. The assembly of claim 8 further comprising an insert mounted to one of the substrates, the other of the substrates having a first socket through which the insert is disposed to define an axis about which the first substrate pivots when attaching to the second substrate.

10. The assembly of claim 9 further comprising a fastener mounted to one of the substrates, the other of the substrates having a second socket through which the fastener is disposed to attach the first substrate to the second substrate, wherein the first substrate follows an arcuate path about the axis when pivotally attaching to the second substrate.

11. The assembly of claim 8 wherein the conductive member is a plurality of conductive members, each conductive member disposed in one of the slots.

12. The assembly of claim 8 wherein the contact area of the conductive member includes a raised portion to which one of the conductive areas of the base portion engages when the male and female connectors are self-aligned and the male connector is received in the female connector.

13. The assembly of claim 8 wherein the male connector has a first formation formed thereon and the female connector has a second formation formed on the female connector, the second formation formed to complement the shape of the first connector, the first and second formations cooperating together to facilitate the self-alignment.

14. The assembly of claim 8 wherein the wire area of the conductive member includes a crimp portion configured to have the second electrical conductor crimped thereto.

15. The assembly of claim 8 wherein one of the conductive areas of the male connector includes a crimp portion configured to have the first electrical conductor crimped thereto.

16. The assembly of claim 8 wherein the first and second electrical conductors are electrical wires.

17. A self-aligning door panel assembly of a vehicle for connecting first and second electrical conductors, the assembly comprising:

first and second substrates of the vehicle, the first substrate attached to the second substrate;

a male connector mounted to the first substrate, the male connector having a base portion and a head portion, the head portion tapering from the base portion to form an arcuate top, the base portion having a plurality of conductive areas spaced circumferentially apart on the base portion and adapted to connect to the first electrical conductor;

a female connector mounted to the second substrate, the female connector having a body portion defining an opening and having inner and outer surfaces, the inner surface of the female connector receiving the male connector, the inner surface being formed to complement the shape of the male connector and cooperable with the arcuate top of the male connector to facilitate the self-alignment of the male and female connectors, the outer surface having a plurality of slots spaced circumferentially apart on the outer surface, the plurality of slots being in radial alignment with the plurality of conductive areas of the base portion when the male and female connectors are self-aligned and the male connector is received in the female connector; and a conductive member accessible by way of one of the slots of the female connector, the conductive member having a contact area and a wire area, the wire area adapted to connect the second electrical conductor, the contact area engaging one of the conductive areas of the male connector when the male and female connectors are self-aligned and the male connector is received in the female connector, wherein the first and second substrates are in aligned relationship with each other such that when the first substrate connects to the second substrate the female connector receives male connector, thereby attaching the first electrical conductor to the second electrical conductor.

18. The assembly of claim 17 wherein the first substrate is a door panel and the second substrate is a metal sheet of the vehicle.

19. The assembly of claim 17 wherein the first substrate is a metal sheet and the second substrate is a door panel of the vehicle.

20. The assembly of claim 17 further comprising an insert mounted to one of the substrates, the other of the substrates having a first socket through which the insert is disposed to define an axis about which the first substrate pivots when attaching to the second substrate.

21. The assembly of claim 20 further comprising a fastener mounted to one of the substrates, the other of the substrates having a second socket through which the fastener is disposed to attach the first substrate to the second substrate, wherein the first substrate follows an arcuate path about the axis when pivotally attaching to the second substrate.

* * * * *